US008152580B2

(12) United States Patent
Straume et al.

(10) Patent No.: US 8,152,580 B2
(45) Date of Patent: Apr. 10, 2012

(54) LOADING SYSTEM

(75) Inventors: Jarle Straume, Straume (NO); Arild K. Samuelsen, Tananger (NO)

(73) Assignee: Framo Engineering AS, Bergen (NO)

( * ) Notice: Subject to any disclaimer, the term of this patent is extended or adjusted under 35 U.S.C. 154(b) by 0 days.

(21) Appl. No.: 12/443,803

(22) PCT Filed: Oct. 4, 2007

(86) PCT No.: PCT/NO2007/000347

§ 371 (c)(1),
(2), (4) Date: Mar. 8, 2010

(87) PCT Pub. No.: WO2008/041859

PCT Pub. Date: Apr. 10, 2008

(65) Prior Publication Data

US 2010/0178819 A1 Jul. 15, 2010

(30) Foreign Application Priority Data

Oct. 6, 2006 (NO) ..... 20064550

(51) Int. Cl.
*B63B 22/02* (2006.01)

(52) U.S. Cl. ..... 441/4; 441/5

(58) Field of Classification Search ..... 441/3–5; 141/387; 166/350; 405/224.3
See application file for complete search history.

(56) References Cited

U.S. PATENT DOCUMENTS

| | | | | |
|---|---|---|---|---|
| 3,641,602 | A | 2/1972 | Flory et al. | |
| 3,732,841 | A * | 5/1973 | Mayo | 114/295 |
| 4,138,751 | A | 2/1979 | Kentosh | |
| 4,182,584 | A * | 1/1980 | Panicker et al. | 405/224.3 |
| 4,273,066 | A | 6/1981 | Anderson | |
| 5,944,448 | A | 8/1999 | Williams | |
| 6,688,348 | B2 | 2/2004 | Fontenot | |
| 6,755,595 | B2 | 6/2004 | Oram | |
| 2003/0084960 | A1 | 5/2003 | Fontenot | |
| 2005/0109513 | A1 | 5/2005 | Dailey et al. | |

FOREIGN PATENT DOCUMENTS

| | | |
|---|---|---|
| GB | 2 180 809 A | 8/1987 |
| GB | 2 377 237 A | 1/2003 |
| NO | 150791 | 12/1984 |
| NO | 153092 | 1/1986 |
| WO | WO 89/02848 | 4/1989 |
| WO | WO 97/30889 | 8/1997 |

OTHER PUBLICATIONS

Chinese Office Action for corresponding Chinese Patent Application No. 200780037505.3 mailed Apr. 22, 2011.

* cited by examiner

*Primary Examiner* — Stephen Avila
(74) *Attorney, Agent, or Firm* — Merchant & Gould P.C.

(57) ABSTRACT

The present invention relates to a loading system for transferring at least one medium between a first installation and a floating vessel, comprising an anchoring device which can be fixed relative to a seabed, at least one elongated first transfer element, which is normally vertically oriented in an installed state, at least one flexible second transfer element arranged in the extension of the first transfer element by a swivel arrangement which is mounted between the first and second transfer element. The swivel arrangement is rotatable at least about a longitudinal axis of the first transfer element. A free end of the second transfer element, in an installed state when the system is not being used, is located freely suspended in the body of water. The invention also relates to a retrieval system and method.

11 Claims, 11 Drawing Sheets

LOADING SYSTEM

This application is a National Stage Application of PCT/NO2007/00347, filed Oct. 4, 2007, which claims benefit of Ser. No. 20064550, filed Oct. 6, 2006 in Norway and which applications are incorporated herein by reference. To the extent appropriate, a claim of priority is made to each of the above disclosed applications.

The present invention relates to a loading system for transferring at least one medium between a first installation and a floating vessel, a retrieval system for use with such a loading system and a method for connecting the loading system to a vessel.

A number of systems exist for transferring a medium between two units offshore, where one of the units is often a subsea installation, a floating storage unit or a platform and a transport vessel.

Several of these systems have devices whereby, when the vessel is not in use, a transfer hose between the installation and the vessel is positioned partly located on the seabed. Having the hose located in such a position causes severe wear on some parts of the hose, resulting in the need to monitor the wear and carry out regular replacements of parts of the hose. These known loading systems are also often arranged so as to enable the loading vessel to rotate freely according to the weather when it is connected. In some systems this is accomplished by having a swivel system close to the point of attachment between the hose and the vessel, such as a swivel system round the attachment of the hose to the vessel or as a submerged buoy housed in a receiving station in the vessel where the actual buoy or the end of the hose that is attached to the vessel comprises swivel devices, described, for example, in U.S. Pat. No. 6,688,348. In this case either the vessel must have a swivel system or alternatively a relatively heavy buoy/hose end will be required which has to be pulled up into the vessel by a swivel. The flexible hose, however, offers rather more limited flexibility. Another known system is the arrangement of a swivel system at the anchor point of the hose to the seabed. This provides greater flexibility since the axis of rotation is located at the seabed, but with such a solution all the dynamic elements are on the seabed with the problems this entails with regard to maintenance and repair. There are also systems which have anchored towers with swivel devices located above the surface of the water. However, these are exposed to wind and weather and represent an obstruction to traffic on the water.

An object of the present invention is to provide a system which reduces the problems associated with previously known loading systems. It is a further object to provide a loading system which impedes shipping to the least possible extent, can be employed in a relatively large weather window, is easy to use and where the dynamic parts can easily be repaired and maintained. A further object is to provide a system where an assistance vessel is not required for connecting and disconnecting the loading vessel. It is also an object to provide a system which can be used for relatively great depths as well as in areas subject to drift ice and icebergs.

These objects are achieved by a system as defined in the following independent claims where further features of the invention will be apparent from the dependent claims and the following description.

The present invention relates to a loading system for transferring at least one medium between a first installation and a floating vessel. The first installation may need to transfer one or more media, such as a fluid, gas and/or liquid, signals, electricity, etc. The first installation may be a storage station in the form of a platform, either floating or fixed to the bottom, a vessel, a subsea storage station for a well, a well, a manifold for several wells or other types of installation located in connection with a body of water. The floating vessel will normally be a loading ship, but may also be other types of floating vessels such as a production ship, interim storage vessel or the like.

The loading system according to the invention comprises an anchoring device which can be fixed relative to a seabed, at least one elongated first transfer element, normally vertically oriented in an installed state and connected to the anchoring device, comprising devices for connection to the first installation, a buoyancy system for ensuring that the first transfer element is under tension in an installed state, at least one flexible second transfer element arranged in the extension of the first transfer element, with a swivel arrangement mounted between the first and second transfer element, which swivel arrangement is rotatable at least about a longitudinal axis of the first transfer element, where a free end of the second transfer element comprises devices for connection to the floating vessel and in an installed state when the system is not being used are located freely suspended in the body of water.

A loading system of this kind for transfer of medium is particularly suitable for use at depths typically from 100 meters and greater. It is also suitable for greater depths from 1000 meters and greater.

The anchoring system may be any type of anchoring device which, when installed, is in a fixed position relative to the seabed. In this application, the term "seabed" should be understood to include the bed of a lake or fjord. In an embodiment the first transfer element may comprise internal devices for transfer of more than one type of medium, for example by having coaxial internal annuli or spaces or pipes extending substantially parallel in the longitudinal direction of the transfer element. It may also be composed of an assembly of a plurality of hoses or pipes. In an embodiment the first transfer element may also be a substantially rigid pipe, such as, for example, a normal riser. This rigid pipe may be composed of several parts, which, for example, are welded or screwed together. It is also conceivable for the first transfer element to be a flexible element such as a hose.

This first transfer element is connected to the anchoring device in such a manner that a point of the first transfer element is kept stable relative to the seabed. This point of the first transfer element which is kept stable may be close to the seabed or at a distance from the seabed. In an embodiment the first transfer element may be extended some distance past this point which is connected to the anchoring device, thus enabling it to be easily connected to devices mounted on the seabed and/or wells, thereby providing transfer of the desired medium. In a second embodiment the connection point between the anchoring device and the first transfer element is provided at a good distance from the seabed, with the result that the first transfer element is terminated at a distance from the seabed and connected to the first installation at this point. In this case the first installation may be a floating unit which is connected to the loading system according to the invention via a transfer line located floating in the body of water between the first installation and the loading system. A combination of these alternatives may also be envisaged.

A second end of the first transfer element facing away from the anchoring device and located in an installed state in the body of water above the anchoring device is normally located at a depth substantially outside the wave zone, normally 30-50 meters below the surface. At such a depth the relatively upper end of the first transfer element will not represent an obstruction to shipping and the influence of the waves on the end will also be minimal.

The system comprises a buoyancy system which in an installed state keeps the first transfer element under tension. This buoyancy system may comprise one or more buoyancy elements at an end of the first transfer element away from the anchoring device and/or buoyancy devices along the first transfer element. If the buoyancy element has been mounted at an end of the first transfer pipe, this may be at the top of the pipe, between the pipe and the swivel arrangement and/or secured to the pipe but mounted with the swivel arrangement between the top of the pipe and the buoyancy element. The buoyancy system may have adjustable buoyancy or include buoyancy elements with fixed, non-adjustable buoyancy, or a combination thereof.

The second transfer element is a flexible element, which should be understood to mean that a longitudinal axis for the second transfer element can be bent, for example, into an S or a J-shape. This can be achieved in various ways, either by means of an inherently flexible element such as a hose or an element composed of a number of rigid elements which together form a flexible element. In an installed state when the system is not in use, the flexible transfer element has an orientation substantially parallel to the first transfer element, and the free end is located at a distance from the seabed. The free end of the flexible second transfer element will also be located at a distance from a connection of the loading system to the first installation. This should be understood to mean that a connecting point for the first installation to the loading system will normally be located vertically below the free end of the flexible second transfer element when it is installed and not in use. The free end of the flexible second transfer element comprises a coupling for joining with a receiving device on board a vessel, where this coupling may be a standard hose coupling. In a normal service position the flexible transfer element will have a so-called gooseneck at the attachment to the swivel arrangement and the first transfer element. The flexible element, moreover, may normally have a vertical lower point during use when it is connected to a vessel, which lower point is located vertically below a horizontal plane of rotation for the swivel arrangement between the first and the second transfer element. This provides the system with greater flexibility, since the vessel has greater freedom before it has to release the end of the second transfer element, in addition to which with such an arrangement, the second transfer element and the system as such experience a minimum amount of strain.

When the system is installed, the swivel arrangement mounted between the first and the second transfer element is therefore located at a depth of around 30-50 meters. The swivel arrangement comprises a first swivel unit with an axis of rotation substantially parallel to a longitudinal axis of the elongated first transfer element. The inlet of this first swivel unit is usually parallel to the longitudinal axis of the first transfer element. Where there is only one swivel unit in the swivel arrangement, the outlet of the swivel unit has an orientation which is not parallel to the longitudinal axis and forms an angle thereto. The swivel arrangement may also comprise a second swivel unit with a second axis of rotation oriented with a different axis of rotation to the first swivel unit, in an embodiment substantially perpendicular relative to the first axis of rotation. The result of having these two swivel units is to relieve the stress and strain on the transfer between the first and the second transfer element, as well as providing a loading system capable of withstanding greater moments since the strain on the second transfer element is relieved at the attachment point with the second swivel unit. A swivel arrangement of this kind makes it possible for the flexible transfer element to be rotated relative to the first transfer element. The vessel which is secured to the second transfer element thereby acquires a very large operating surface in a connected state. The S-shape of the second transfer element with the vertical lower point arranged below the swivel arrangement also permits the vessel to move for some distance directly towards a vertical axis of rotation for the swivel arrangement. With a direction slightly to the side of the vertical axis of rotation this swivel will be rotated. The aforementioned vertical axis of rotation is an axis of rotation substantially parallel to the first transfer element, as indicated above, but this axis may have an angular deviation of at any rate 15 degrees with a vertical axis. One or both of the swivel units in the swivel arrangement may also include locking devices in order to be able to lock or restrict the rotating motion at one point.

Thus in an embodiment at least a part of the buoyancy system, usually a buoyancy element, forms a base for the swivel arrangement. The swivel arrangement may be connected to this buoyancy element by releasable couplings which make it easy to detach the swivel arrangement from the first transfer element when it has to be taken to the surface for repair and maintenance. Otherwise this swivel arrangement is mounted at a depth which enables repairs to be carried out on site, for example by divers or ROV. If the swivel arrangement has to be released and raised to the surface, it will be possible to lock the swivels by means of the locking devices, thereby making it easier to lift them straight up from the loading system after being released. Devices will normally also be provided for facilitating the release or replacement of the flexible second transfer element from the swivel arrangement. Valves and the like will be provided in the system to ensure that no environmentally harmful media are released to the environment. This will be understood by a person skilled in the art.

According to the invention the first transfer element may also comprise shock-protection devices in the area where a free end of the flexible second transfer element will be located in an installed state when not in use. These shock-protection devices may be of different types such as mats placed round the first transfer element or more projecting framework to prevent the end of the second transfer element from knocking against the first transfer element. The end of the second transfer element may also include devices for eliminating/minimising any damage should the second transfer element come into contact with the first transfer element.

In an embodiment the first transfer element may further comprise a flexible coupling near the securing point to the anchoring device, which coupling permits angular deviation between a longitudinal axis of the first transfer element and a vertical axis when the system is in an installed state. There is a greater need for a flexible coupling of this kind when the system is employed for lesser depths than when it is employed for greater depths, since the length of the first transfer element offers a certain amount of flexibility depending on the length of the first transfer element. In a variant of the invention a portion of the first transfer element may also be mounted at the anchoring device, which portion is provided as a flexible portion of the first transfer element.

The loading system also comprises a retrieval arrangement, thereby enabling a vessel to retrieve the free end of the second transfer element and connect the free end to the receiving system on board the vessel. This retrieval arrangement may constitute a standard retrieval arrangement, with a bottom-moored marker buoy, where the buoy and the anchor have to be brought up on to the vessel before work can begin on pulling in the free end. This process has to be reversed when the vessel is to be released. Recovery and deployment of the anchor system takes time and is not advantageous.

As an alternative, a modified retrieval arrangement may be envisaged where instead of a bottom-moored marker buoy, a buoy connected to a retrieval line is used which has increased deadweight in at least one portion compared with the rest of the retrieval line, with the result that the weight of the line causes it to stay on the seabed. Since this weight is attached to and/or integrated in the lines, the lines can be pulled up by normal winches without having to stop the process in order to connect/disconnect the anchor arrangement as has to be done in previously known solutions.

According to the invention other new retrieval arrangements have also been developed which are also easier to use than previous solutions.

The retrieval arrangement according to the invention for a flexible transfer element in a transfer system between a first installation and a vessel, which transfer element in an installed state is arranged freely suspended in the body of water with a substantially vertical orientation and with the free end comprising connecting devices for connection to a vessel at a distance from the seabed, comprises a guide element which is mounted slidably along the transfer element, a recovery line connected to the guide element and the transfer element at one end, and a marker buoy connected to the recovery line at a second end thereof.

In a variant, the guide element comprises buoyancy devices, and the arrangement further comprises a guide line, where the recovery lines are secured to the free end of the transfer element, the guide line is secured to the transfer element near the free end and to the recovery line at a distance from an attachment point between the recovery line and the free end of the transfer element and where the guide element is further mounted slidably along the guide line between its two attachment points.

In a second variant, the guide element comprises weight elements and the recovery line is secured to the guide element, where the arrangement further comprises a releasable holding device for securing the guide element, mounted at a distance from the free end of the transfer element.

In a free state the guide element is freely slidable along the transfer element. Where the transfer element comprises portions with a smaller diameter, the guide element is provided with a length which permits it to come into abutment with the transfer element on both sides of the portion with a smaller diameter, thus preventing it from becoming jammed in the portion with a smaller diameter.

According to the invention a vessel will arrive at the loading system location as described above and pick up the marker buoy, whereupon the vessel reverses away from the loading system and begins to pull in, for example winch in, the recovery line attached to the marker buoy, whereupon the free end of the flexible transfer element is pulled towards the vessel and connected thereto.

A loading system, recovery system and method according to the invention provide a system which can be employed in a larger weather window, the system has great flexibility with regard to the motion of a connected vessel both on the horizontal and vertical plane, by means of the provision of both the swivel arrangement and the flexible transfer element. This provides a system which has increased operational reliability. Furthermore, a retrieval system according to the invention provides a simplified connection and disconnection system. Mounting the dynamic parts on the top of the first transfer element also provides the advantage of simplifying repair and maintenance. The fact that the flexible second transfer element is arranged freely suspended down in the water when the system is not in operation will contribute to less wear on the second transfer element, while a shorter hose is required with such a system, resulting in a saving in costs and a reduction in the dynamic forces influencing the system when it is in operation.

The invention will now be explained in greater detail with reference to the attached figures, in which:

FIGS. 1A-B illustrate the principles of an installed loading system according to the invention when in use and when not in use.

Figure 1A:
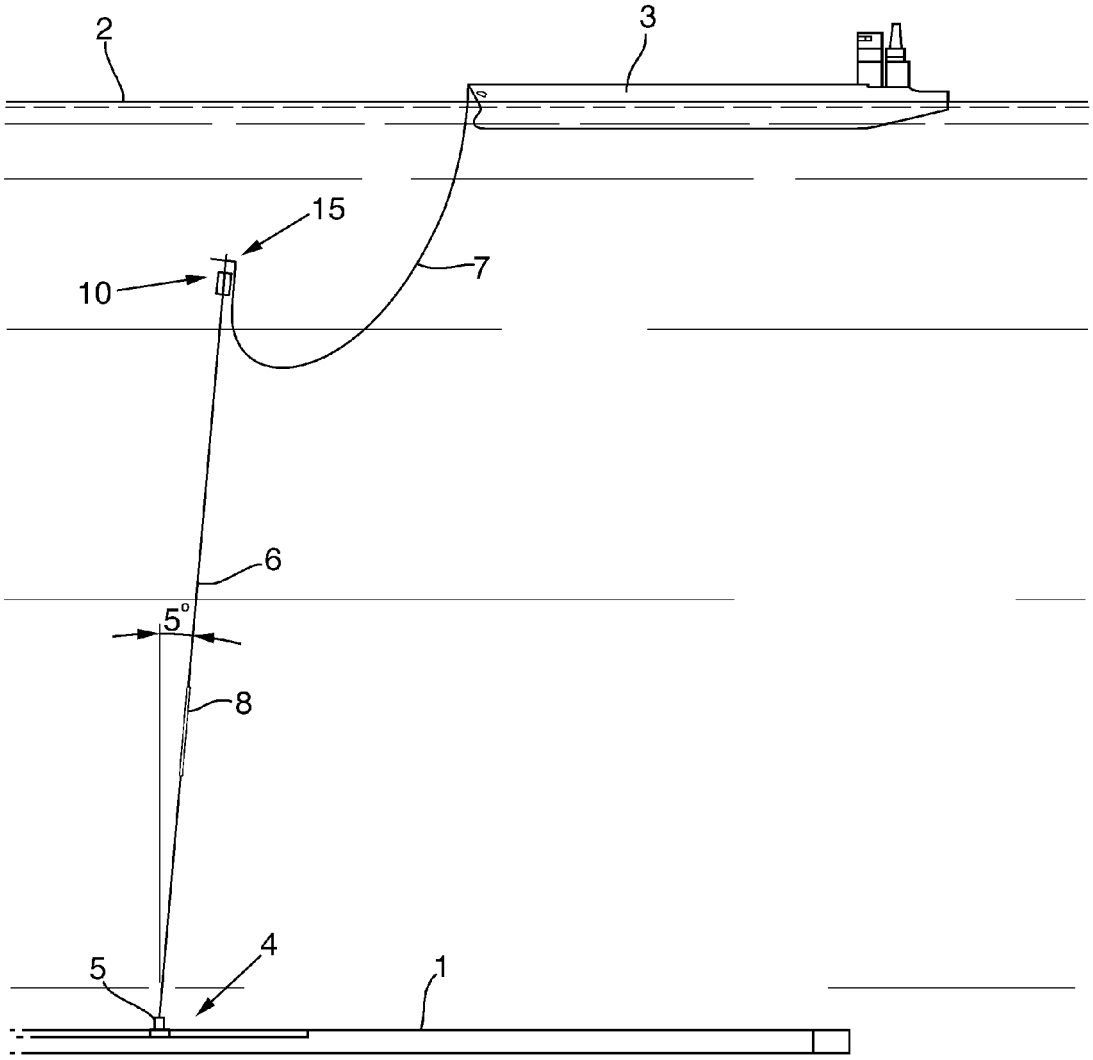
FIG. 1C illustrates an alternative embodiment of an installed loading system when it is not in use.

In FIGS. 1A and B a loading system according to the invention is illustrated during use and when not in use. The loading system comprises an anchoring device 5 located on a seabed 1 under a body of water with a surface 2. To the anchoring device 5 is connected a first elongated transfer element 6 which is arranged substantially vertically in the body of water. At the top of the first transfer element 6 is mounted a buoyancy system 10 with the result that the first transfer element 6 is always under tension. At the top of the first transfer element 6 there is also mounted a swivel arrangement 15. A second transfer element 7 is connected via the swivel arrangement 15 with the first transfer element 6. When in a connected state, the second transfer element which is flexible will be connected to a vessel 3 at the surface as indicated in FIG. 1A and when it 7 is not connected it will be freely suspended in the body of water substantially parallel to the first transfer element 6. The first transfer element 6 also comprises shock-protection devices 8 in the area of the first transfer element 6 which is located near a free end of the second transfer element 7 in a disconnected state.

Figure 1B:
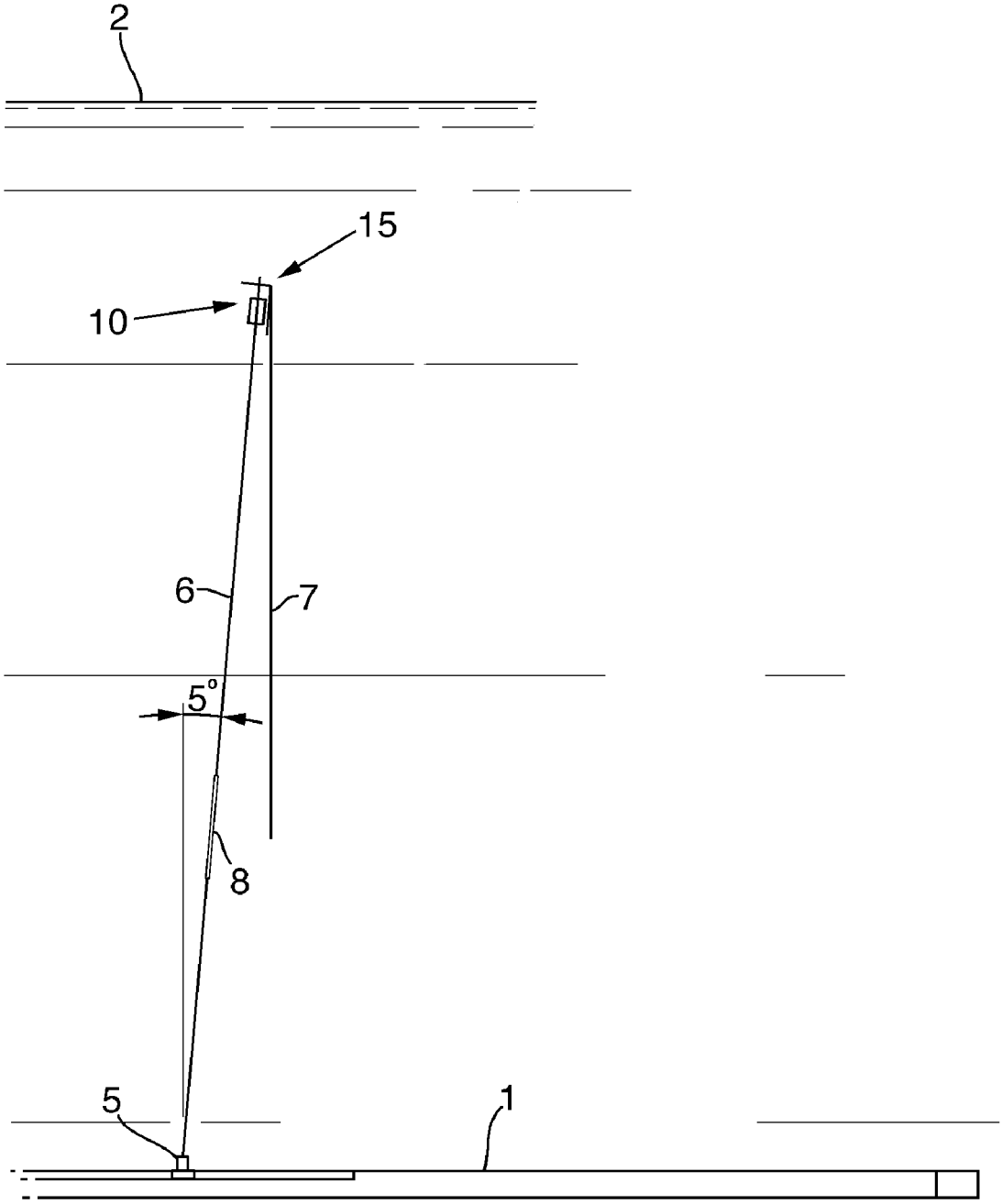
Figure 1C:
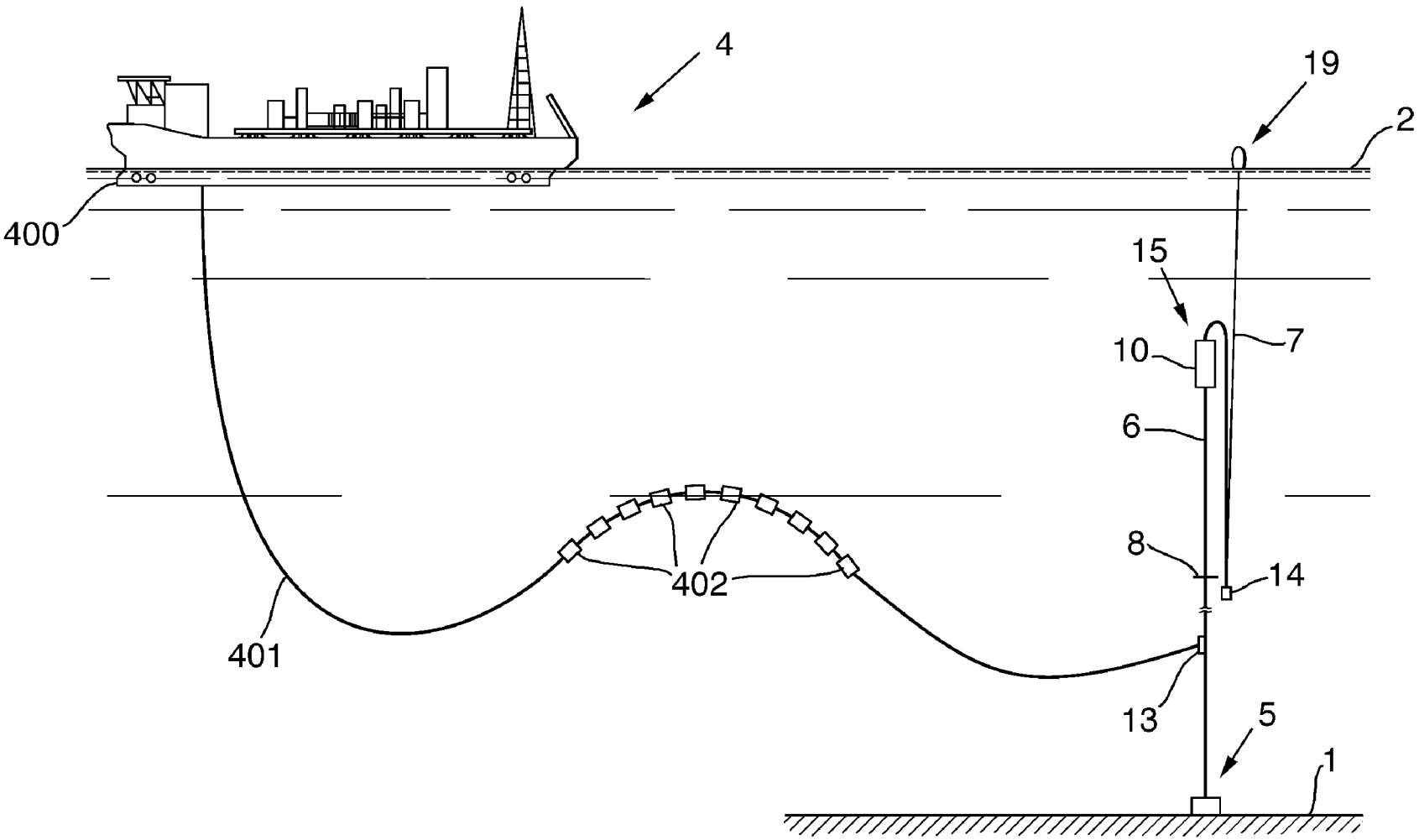

In FIG. 1C an alternative loading system is illustrated when it is not in use. The loading system is anchored to the seabed 1 via an anchoring device 5. To the anchoring device 5 is secured a first transfer element 6, which at the end facing away from the seabed 1 is joined to the flexible second transfer element 7 via a swivel arrangement 15, mounted in connection with a buoyancy system 10. The first transfer element 6 also comprises shock-protection devices 8, thus preventing a free end of the second transfer element 7 comprising devices 14 for connection to a vessel during use from knocking against the first transfer element 6. A retrieval arrangement 19 for recovering the free end of the second transfer element 7 is also indicated in the figure. In this case the first installation 4 comprises a floating vessel 400, which may be a drilling vessel, production vessel, interim storage vessel or other vessel floating on the surface 2. From this vessel 400 extends a line 401 floating in the body of water for transferring media, which line 401 is also equipped with buoyancy elements 402 which keep it floating in a stable manner in the body of water without being exposed to more stress than necessary. This line 401 is connected with the loading system and the first transfer element 6 by connecting devices 13. The connecting devices 13 are mounted at a good distance from the seabed 1, thereby avoiding the need for the line 401 to be pulled right down to a seabed in cases where the depth of the water, for example, is over 1000 meters. The connecting devices 13, however, are mounted vertically below a position for the free end of the flexible second transfer element 7, thereby preventing them from getting in each other's way. In a variant the first transfer element 6 may also be terminated at the connecting devices 13 and secured to the anchoring device 5 close to this point, as an alternative to passing it all the way down to the seabed. A transfer element may also be envisaged with several connecting devices which may be mounted at the seabed or at a distance therefrom or a combination thereof.

Figure 2:
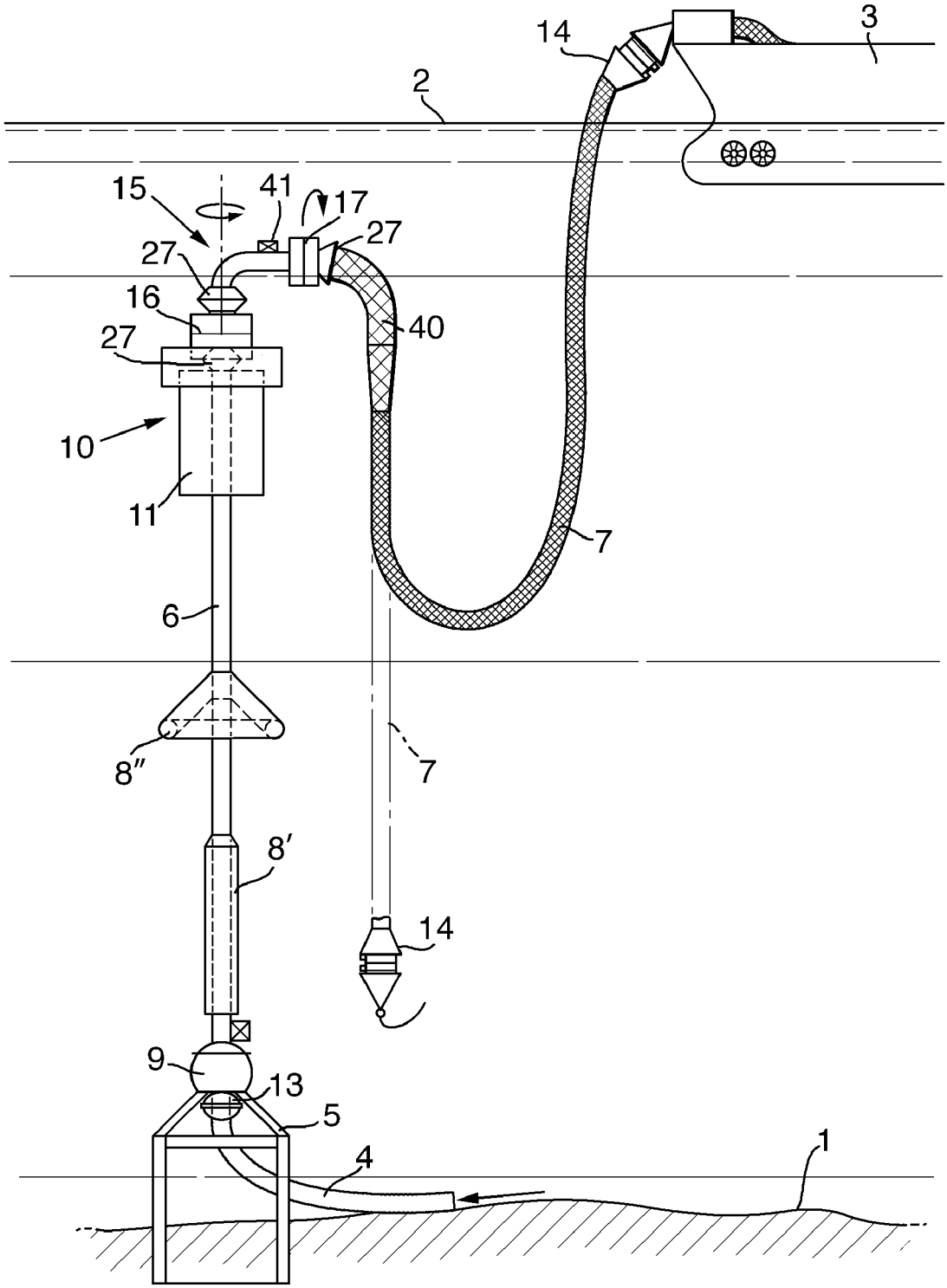
FIG. 2 illustrates a variant of a loading system in a little more detail.

FIG. 2 illustrates a system corresponding to that in FIG. 1 but in rather more detail. The first transfer element 6 is connected to a first installation 4 via a connecting device 13 in connection with the anchoring device 5. The first transfer element 6 further comprises a flexible coupling 9 which permits a longitudinal axis of the first transfer element 6 to form an angle of around 15 degrees with a vertical axis. In this embodiment the shock-protection devices comprise both a mat structure 8' and a distance element 8" in order to prevent contact between the first transfer element 6 and a free end of the second transfer element 7. The buoyancy system 10 comprises a buoyancy element 11 mounted at the top of the first transfer element 6. The top of this buoyancy element forms a base 12 for the swivel arrangement 15. The swivel arrangement 15 comprises a first swivel unit 16 with an axis of rotation substantially parallel to the longitudinal axis of the first transfer element 6, and a second swivel unit 17 with an axis of rotation substantially perpendicular relative to the axis of rotation of the first swivel unit 16. The second transfer element 7 is connected to the outlet of the second swivel unit 17 and via its flexibility is either connected to a vessel 3 with devices 14 for connection to equipment aboard the vessel or suspended substantially parallel to the first transfer element 6 when it is not in use, both variants being indicated in the figure. Furthermore, a coupling 27 is provided between the second swivel unit 17 and the second transfer element 7. Couplings 27 are also provided between the first transfer element 6 and the first swivel unit 16 and between the swivel units 16, 17. This provides the possibility of disconnecting these parts and taking the parts requiring repair up to the surface. The system also comprises sensors 41 for detection of, for example, relative position. Flexural stiffeners 40 may also be mounted in connection with the coupling 27 at the point of attachment of the flexible second transfer element 7 to a fixed part which in this case is represented by the second swivel unit 17. The flexural stiffener 40 extends from the coupling 27 for some length beyond the second transfer element 7.

Figure 3:
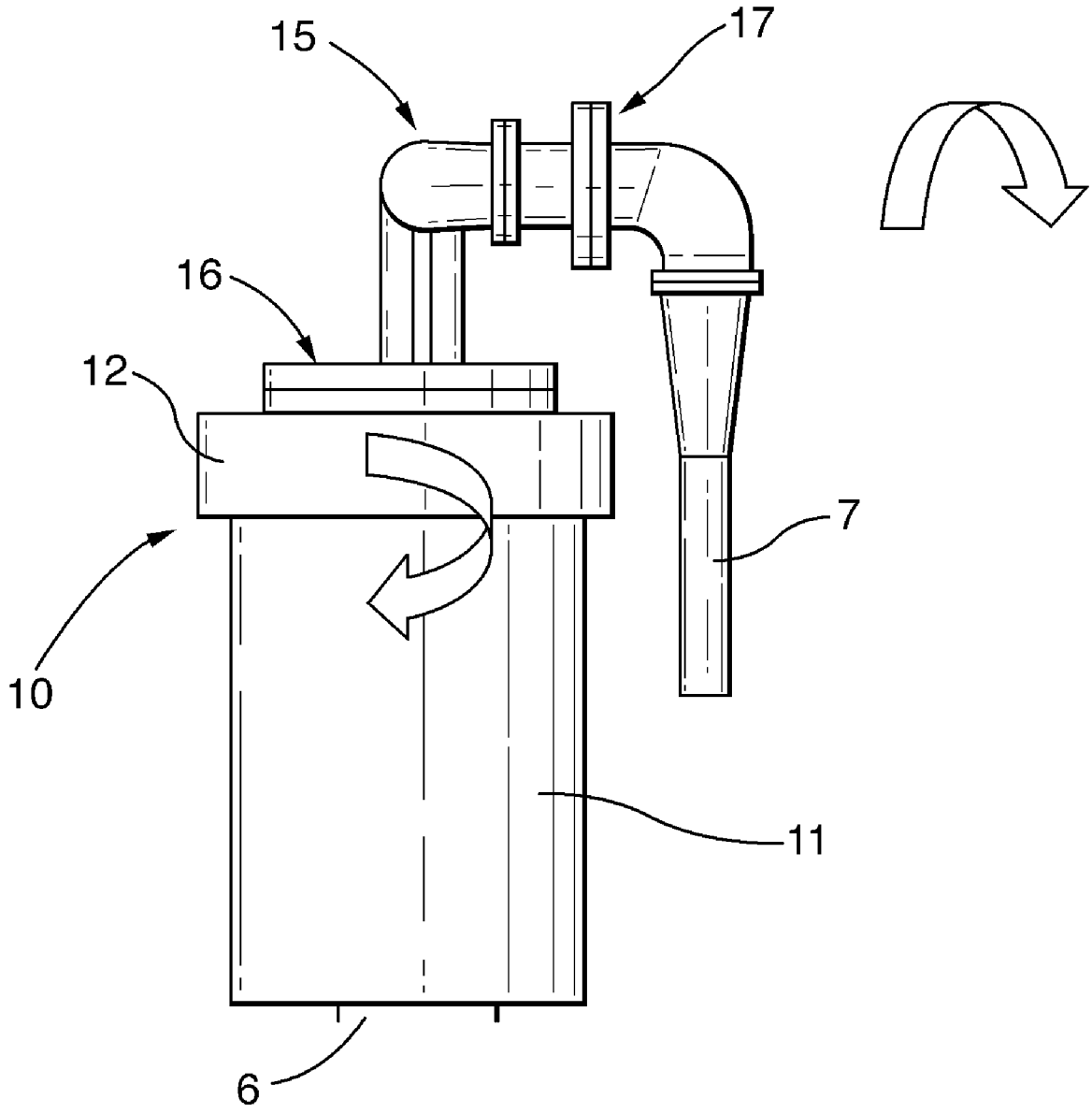
FIG. 3 illustrates a buoyancy system and the swivel arrangement.

In FIG. 3 the buoyancy system 10 and the swivel arrangement 15 are depicted in a more schematic way. Here it can be clearly seen that the axis of rotation for the first swivel unit 16 is perpendicular relative to the axis of rotation of the second swivel unit 17. A rigid pipe piece is also mounted between the outlet of one swivel unit and the inlet of the second swivel unit, since the outlet and the inlet have different orientation.

Figure 4A:
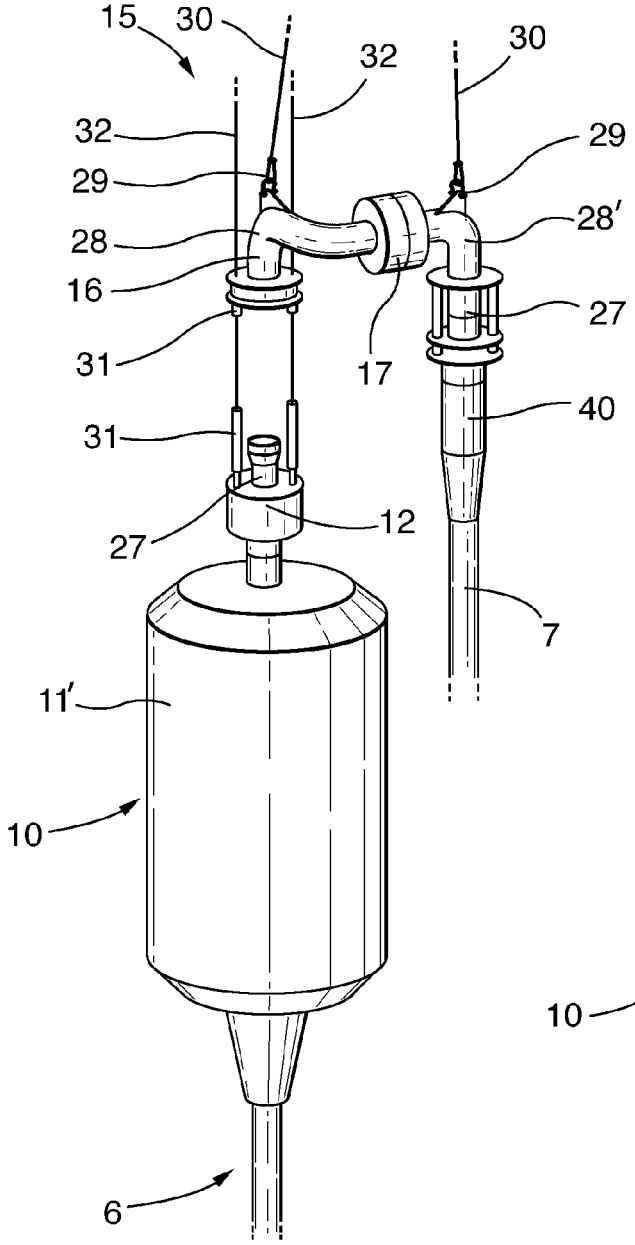
FIG. 4 illustrates a possible variant for connection of the swivel arrangement's parts to the first transfer element
Figure 4B:
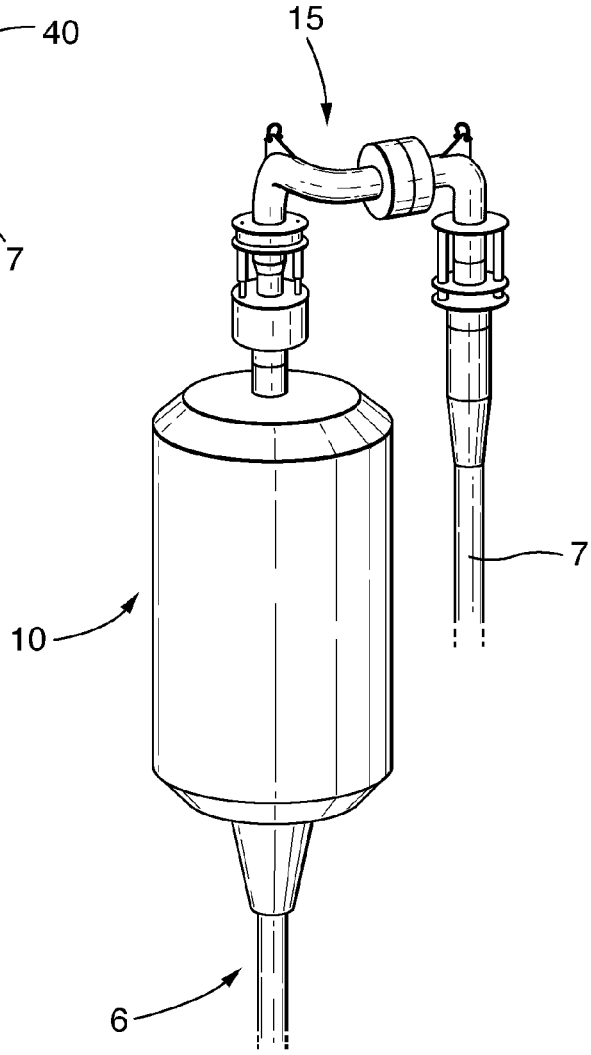
Figure 5B:
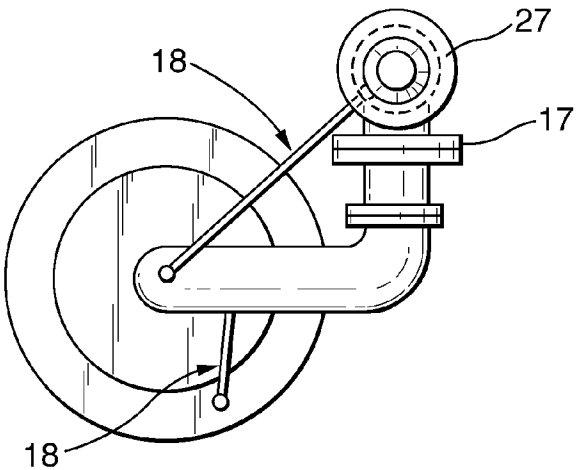
FIGS. 5A-B illustrate a connection of the second transfer element to the swivel arrangement, viewed from the side and from above.
Figure 5A:
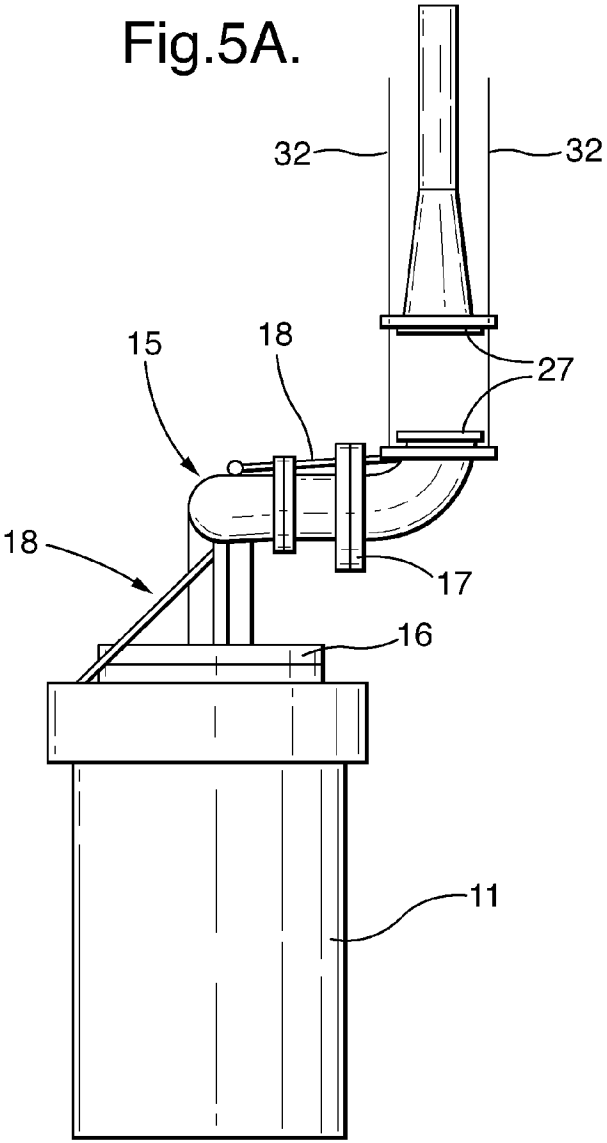

FIG. 4 illustrates a variant where the swivel arrangement 15 is connected to an upper end of the first transfer element 6. The left side of the figure shows it being connected and the right side shows it in a connected condition. In this case the buoyancy system 10 comprises buoyancy elements 11' mounted on the upper end of the first transfer element 6, forming a part of a base 12 for the swivel arrangement 15. The system is provided with a rigid pipe element 28 between the swivel units 16, 17, where the first swivel unit has a substantially vertical axis of rotation and the second swivel unit 17 has a substantially horizontal axis of rotation, the swivel units 16, 17 being locked against rotation during the installation. At the outlet of the second swivel unit 17 the swivel arrangement comprises an additional pipe element 28' which is terminated against a coupling 27 against the flexible second transfer element 7. It can also be seen that the flexible second transfer element 7 is provided with a flexural stiffener 40 in the area of connection with the coupling 27. The system also comprises lifting lugs 29 for attaching lifting wires 30, and guide elements 31, in the form of pins and funnels, and guide wires 32 for correct insertion of the elements in the coupling 27 between the swivel arrangement 15 and the top of the first transfer element 6.

Where it is only a case of repairing the second flexible transfer element 7, the first and second swivel units 16, 17 can be locked by means of locking devices 18, thus preventing them from rotating freely, as indicated in FIGS. 5A and B. In this case too guide wires 32 may be employed for correct insertion of the parts of the coupling 27 between the second transfer element 7 and the swivel arrangement 15.

Figure 6:
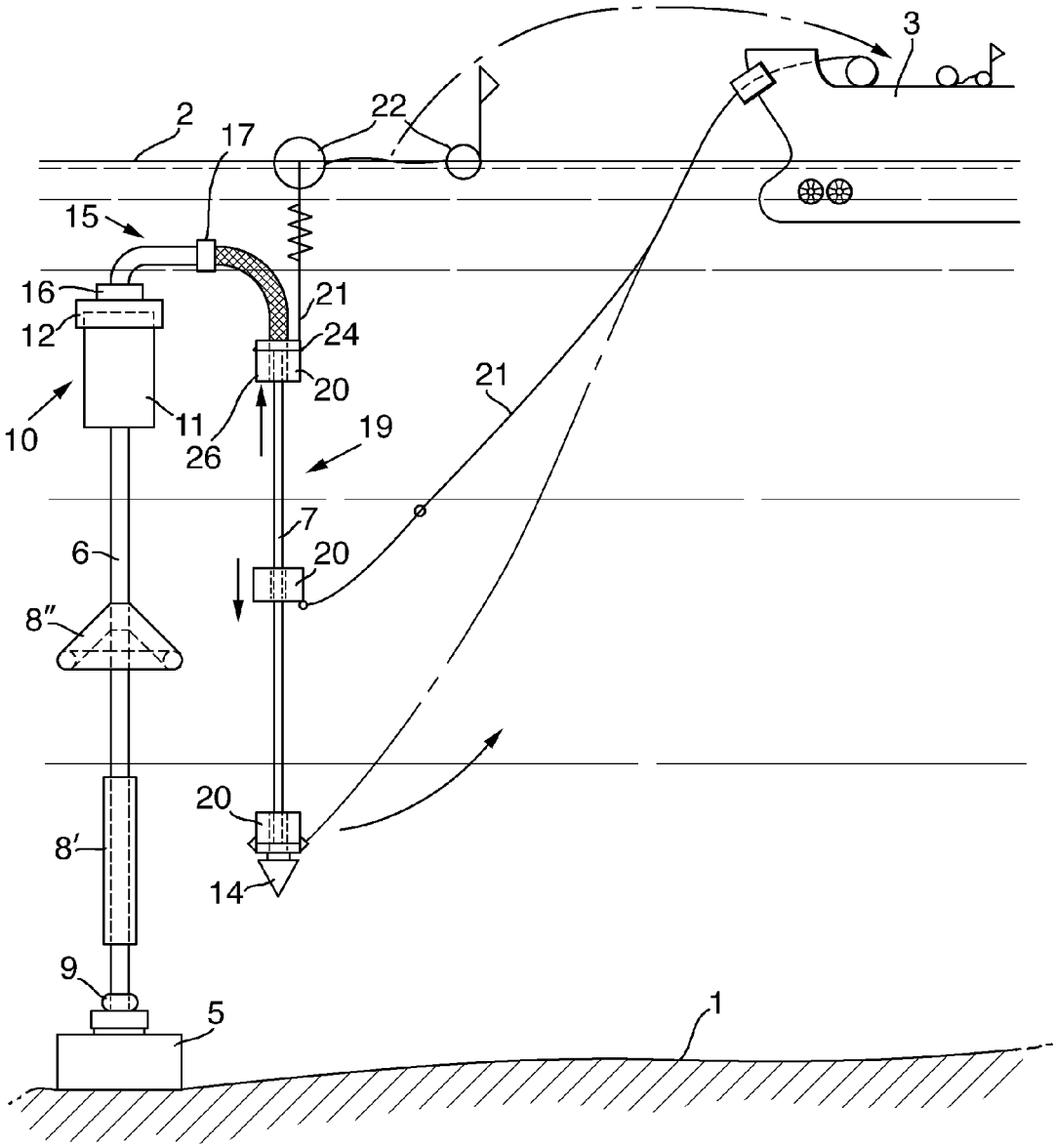
FIG. 6 illustrates a first retrieval arrangement.

FIG. 6 illustrates a first variant of a retrieval arrangement 19. A guide element 20 is arranged slidably along the flexible second transfer element 7. In this embodiment the guide element 20 comprises weight elements 26 and is connected to a recovery line 21. The recovery line 21 is connected at its other end to one or more marker buoys 22 when the system is not in use. The vessel 3 will pick up the marker buoy 22. A releasable holding device 24 at the attachment of the flexible transfer element 7 to the swivel arrangement 15 will release guide element 20 which on account of its weight will fall down over the second transfer element 7 to the free end thereof, whereupon, by winching in the recovery line 21, the vessel can pick up the free end with the connecting devices 14 and connect the free end to the vessel 3. When the vessel is released, the process is reversed.

Figure 7:
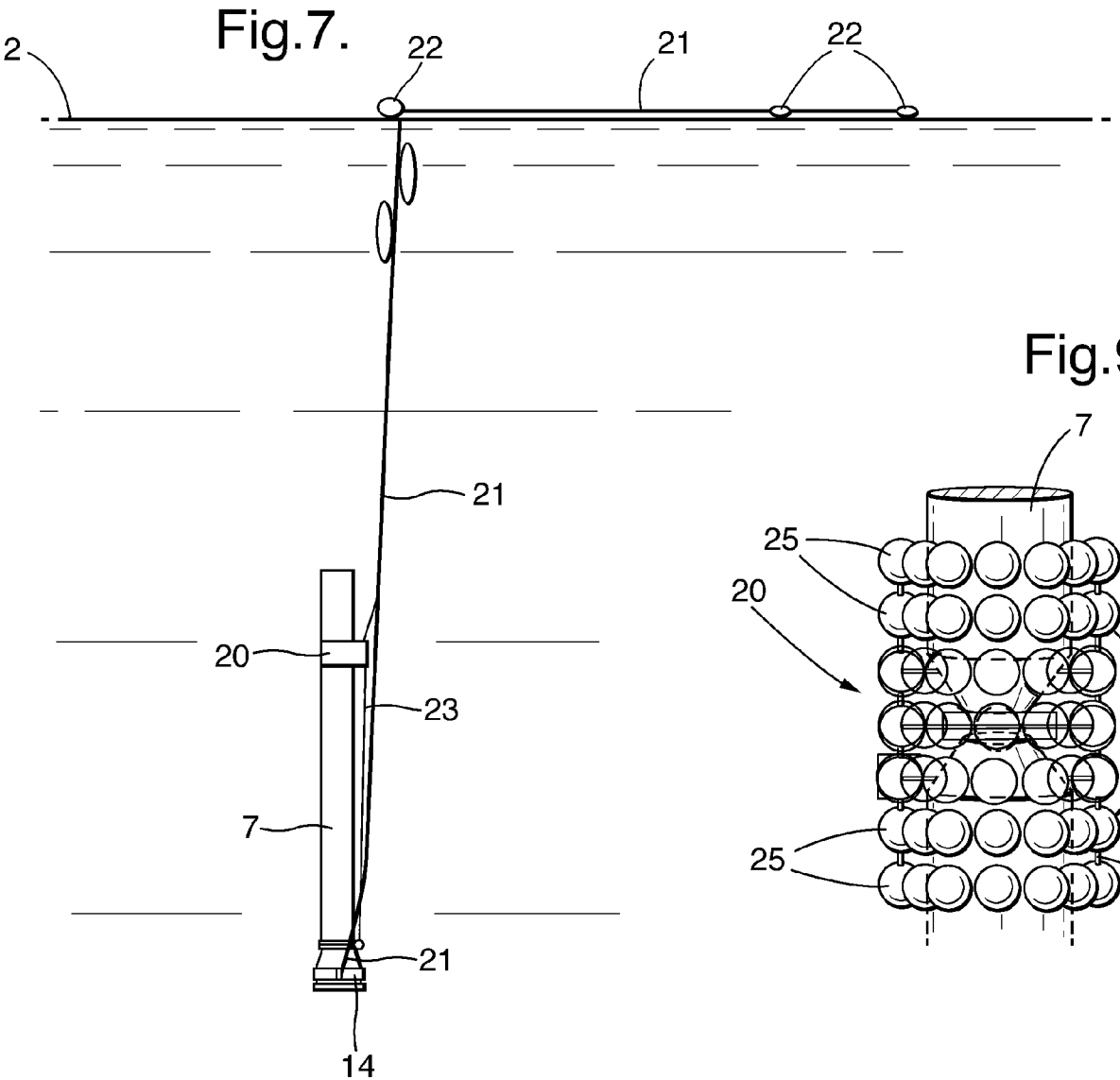
FIG. 7 illustrates a second retrieval arrangement.
Figure 8:
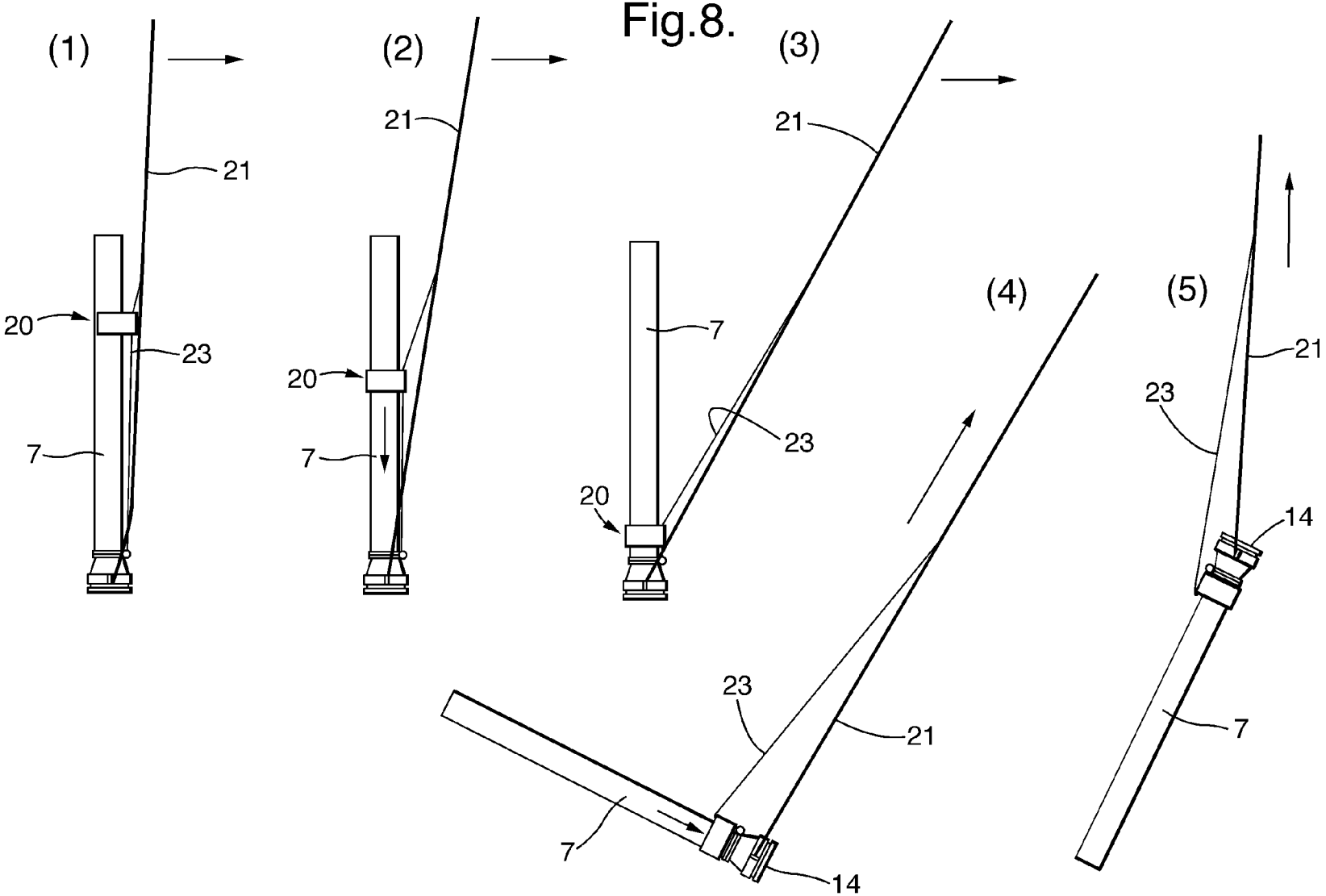
FIG. 8 illustrates five sequences for use of the retrieval arrangement illustrated in FIG. 7.

An alternative retrieval arrangement is illustrated in FIG. 7 and the five sequences in FIG. 8. The guide element 20 is mounted slidably on the flexible transfer element 7. In this case the recovery line 21 is secured directly to the free end of the flexible transfer element 7. Furthermore, a guide line 23 is secured to the end of the flexible transfer element 7 and a point on the recovery line 21 at a distance therefrom. The guide element 20 is connected slidably to the guide line 23. When a vessel has picked up the marker buoy 22 and begins to winch in the recovery line while reversing away from the loading system, the guide line 23 and the guide element 20 with their built-in buoyancy will guide the lifting point between the recovery line 21 and the flexible transfer element 7 to the end of the flexible transfer element 7, as illustrated in the sequences 1 to 5.

Figure 9:
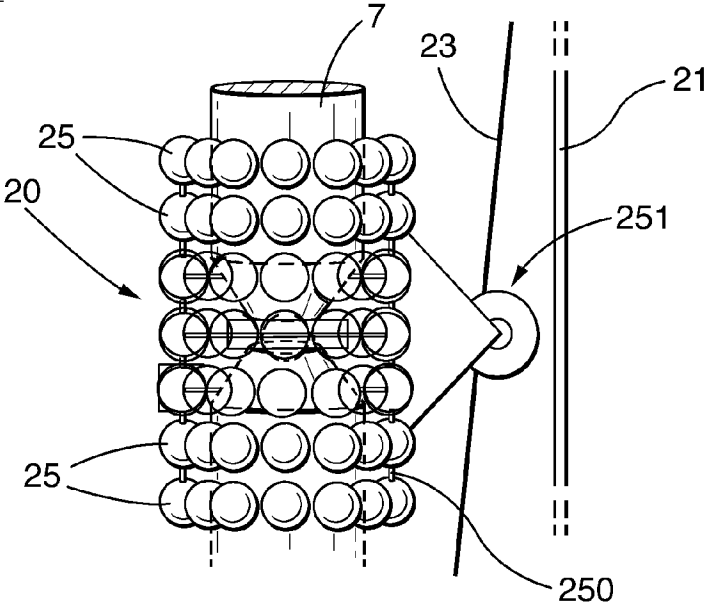
FIG. 9 illustrates an alternative guide element.

FIG. 9 illustrates a possible design of a guide element for use in the retrieval arrangement depicted in FIGS. 7 and 8. The flexible transfer element 7 will normally be composed of several elements and the junction of these elements will usually have a slightly smaller diameter than the rest of the transfer element 7. In order to prevent the guide element 20 becoming jammed when sliding over these portions of the transfer element 7, it is preferably provided with a length that permits an end of the guide element 20 to abut against the transfer element 7 on a side of the portion with smaller diameter, before the opposite end of the guide element 20 comes to the portion with smaller diameter. For a guide element with built-in buoyancy, this can be accomplished by providing the guide element 20 with a plurality of buoyancy devices 25 in the form of balls provided rotatingly relative to a frame 250. This also helps to provide good sliding conditions between the guide element 20 and the transfer element 7. As illustrated, the guide element 20 may also include a caster 251 to facilitate the running of the guide line 23.

The retrieval arrangement according to the invention with a guide element running along the flexible transfer element will also have the effect of cleaning fouling off the flexible transfer element.

Figure 10:
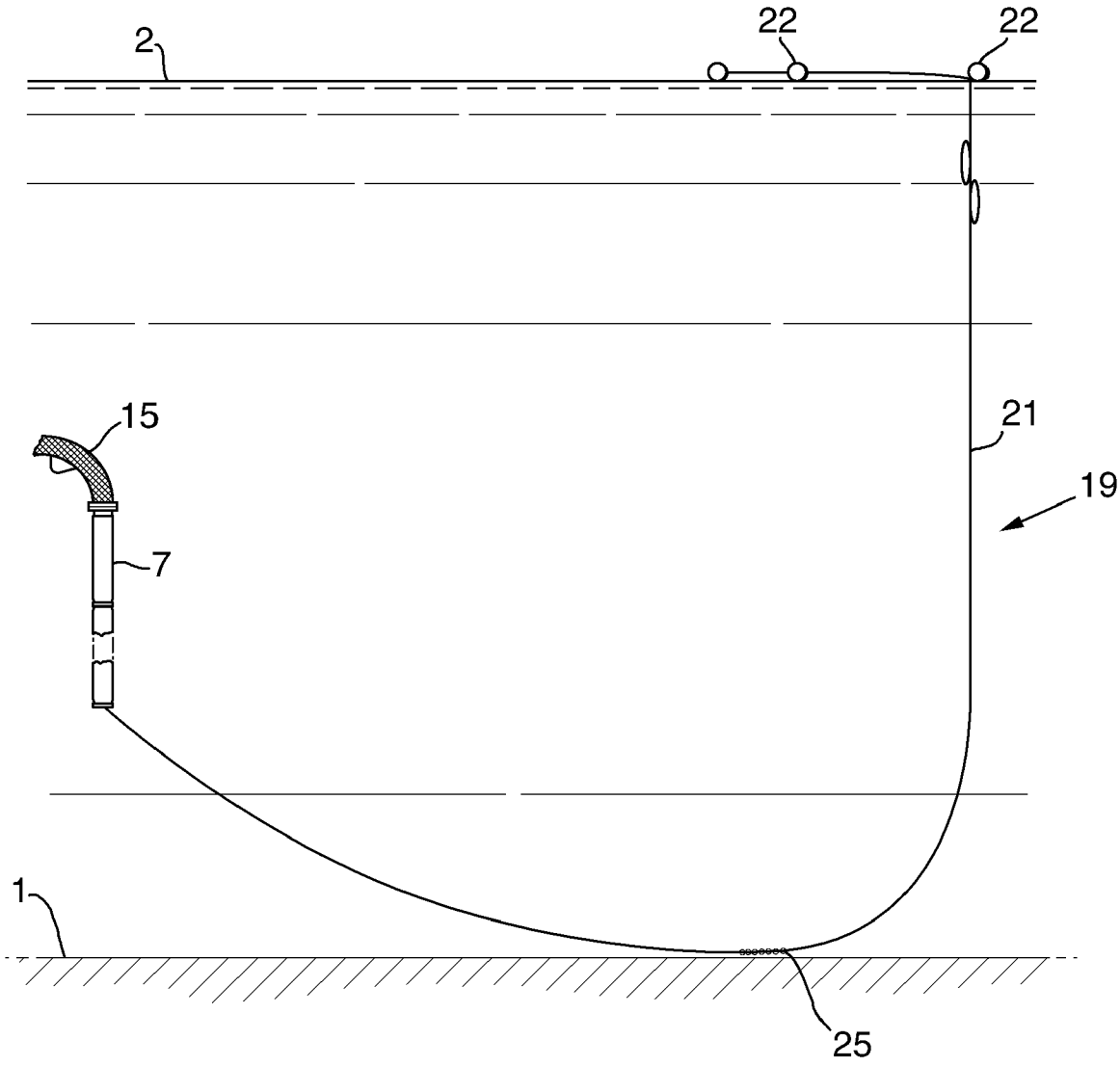
FIG. 10 illustrates a third retrieval arrangement.

An alternative retrieval arrangement is illustrated in FIG. 10, where the flexible second transfer element 7 is shown connected to a swivel arrangement 15, with the rest of the loading system not illustrated. A recovery line 21 is connected to the free end of the second transfer element 7. The recovery lines 21 extend from the free end down to a portion 25 of the recovery lines 21 close to or located on the seabed 1, whereupon it extends up to a marker buoy 22 at the surface 2, thus enabling the recovery line to be picked up by a vessel which is to be connected to the loading system. The portion 25 of the recovery lines is a weighted portion of the lines with greater deadweight than the rest of the line. The weight may be included in the lines, be provided by an external weight element, be woven into the lines or arranged on the lines in another way. By means of such a device the line can be handled by winches on board a vessel without having to stop the recovery/deployment process in order to disconnect an anchor, for example, from the recovery line. This is an advantageous solution.

The invention has now been explained with reference to special embodiments illustrated in the attached figures. A person skilled in the art will appreciate that changes and modifications may be made to these embodiments which fall within the scope of the invention as defined in the attached claims. The loading system will also be equipped with the necessary shut-off valves, corrosion protection, etc. which will be understood by a skilled person.

The invention claimed is:

1. A loading system for transferring at least one medium between a first installation and a floating vessel, comprising an anchoring device which can be fixed relative to a seabed, at least one elongated first transfer element, normally vertically orientated in an installed state and connected to the anchoring device, comprising devices for connection to the first installation, a buoyancy system for ensuring that the first transfer element is under tension in an installed state, at least one flexible second transfer element arranged in the extension of the first transfer element, wherein a swivel arrangement is mounted between the first and second transfer element, which swivel arrangement comprises a first swivel unit with an axis of rotation substantially parallel to a longitudinal axis of the elongated first transfer element, and a second swivel unit with a second axis of rotation oriented substantially perpendicularly relative to the first axis of rotation, where a free end of the second transfer element comprises devices for connection to the floating vessel and in an installed state when the system is not being used are located freely suspended in the body of water and has an orientation substantially parallel to the first transfer element.

2. A loading system according to claim 1, wherein the buoyancy system comprises a buoyancy element at an end of the first transfer element away from the anchoring device and/or buoyancy devices along the first transfer element.

3. A loading system according to claim 2, wherein the buoyancy element forms a base for the swivel arrangement.

4. A loading system according to claim 1, wherein the first transfer element includes shock-protection devices.

5. A loading system according to claim 1, wherein the first transfer element further comprises a flexible coupling close to the anchoring device, which coupling in an installed state of the system permits angular deviation between a longitudinal axis of the first transfer element and a vertical axis.

6. A loading system according to claim 1, wherein it comprises a retrieval arrangement.

7. A loading system according to claim 6, wherein the retrieval arrangement comprises a recovery line connected to the free end of the second transfer element, which recovery line extends from the free end down to a portion of the recovery line close to or located on the seabed, whereupon it extends up to a marker buoy at the surface.

8. A loading system according to claim 7, wherein the portion of the recovery line is a weighted portion of the line with greater deadweight than the rest of the line, wherein the weight may be included in the line, provided by an external weight element, or woven into the line.

9. A retrieval arrangement for a flexible transfer element in a transfer system between a first installation and a vessel, which transfer element in an installed state is arranged freely suspended in a body of water with a substantially vertical orientation and with a free end comprising connecting devices for connection to the vessel at a distance from a seabed, wherein the retrieval arrangement comprises a guide element which is mounted slidably along the transfer element, a recovery line connected to the guide element and the transfer element at one end, and at least one marker buoy connected to the recovery line at a second end thereof, and wherein the guide element comprises buoyancy devices, and the arrangement further comprises a guide line, where the recovery lines are secured to the free end of the transfer element, the guide line is secured to the transfer element near the free end, to the recovery line at a distance from an attachment point between the recovery line and the free end of the transfer element and where the guide element is further mounted slidably along the guide line between its two attachment points.

10. A retrieval arrangement for a flexible transfer element in a transfer system between a first installation and a vessel, which transfer element in an installed state is arranged freely suspended in a body of water with a substantially vertical orientation and with a free end comprising connecting devices for connection to the vessel at a distance from a seabed, wherein the retrieval arrangement comprises a guide element which is mounted slidably along the transfer element, a recovery line connected to the guide element and the transfer element at one end, and at least one marker buoy connected to the recovery line at a second end thereof, and wherein the guide element comprises weight elements and the recovery line is secured to the guide element, where the arrangement further comprises a releasable holding device for securing the guide element when the system if not in use, mounted at a distance from the free end of the transfer element.

11. A method for connecting a loading system according to claim 1 with a retrieval system, wherein the vessel arrives at the loading system location and picks up a marker buoy, whereupon the vessel reverses away from the loading system and begins to pull in a recovery line which is attached to the marker buoy, whereupon the free end of the flexible transfer element is pulled towards the vessel and connected thereto.

* * * * *